US012385653B2

(12) United States Patent
Lee et al.

(10) Patent No.: US 12,385,653 B2
(45) Date of Patent: Aug. 12, 2025

(54) AIR CONDITIONING SYSTEM AND METHOD FOR CONTROLLING AIR CONDITIONING SYSTEM

(71) Applicant: LG ELECTRONICS INC., Seoul (KR)

(72) Inventors: Jisung Lee, Seoul (KR); Yongcheol Sa, Seoul (KR); Chiwoo Song, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 508 days.

(21) Appl. No.: 17/778,477

(22) PCT Filed: Aug. 26, 2020

(86) PCT No.: PCT/KR2020/011420
§ 371 (c)(1),
(2) Date: May 20, 2022

(87) PCT Pub. No.: WO2021/153870
PCT Pub. Date: Aug. 5, 2021

(65) Prior Publication Data

US 2023/0003399 A1 Jan. 5, 2023

(30) Foreign Application Priority Data

Jan. 29, 2020 (KR) ..... 10-2020-0010248

(51) Int. Cl.
*F24F 3/06* (2006.01)
*F24F 11/47* (2018.01)

(52) U.S. Cl.
CPC ..... *F24F 3/065* (2013.01); *F24F 11/47* (2018.01)

(58) Field of Classification Search
CPC ..... F24F 3/065; F24F 11/47
See application file for complete search history.

(56) References Cited

U.S. PATENT DOCUMENTS

| | | | | |
|---|---|---|---|---|
| 11,338,647 | B1 * | 5/2022 | Johnston | B60H 1/32011 |
| 2006/0107683 | A1 | 5/2006 | Song et al. | |
| 2012/0042674 | A1 | 2/2012 | Takenaka et al. | |
| 2013/0233008 | A1 | 9/2013 | Yamashita et al. | |

(Continued)

FOREIGN PATENT DOCUMENTS

| | | |
|---|---|---|
| CN | 1782551 | 6/2006 |
| CN | 101440989 | 5/2009 |

(Continued)

OTHER PUBLICATIONS

International Search Report dated Nov. 30, 2020 issued in Application No. PCT/KR2020/011420.

(Continued)

*Primary Examiner* — Jerry-Daryl Fletcher
*Assistant Examiner* — Keith Stanley Myers
(74) *Attorney, Agent, or Firm* — KED & ASSOCIATES

(57) ABSTRACT

An air conditioning system and a method for controlling an air conditioning system are provided. The air conditioning system determines loads for each indoor unit of a plurality of indoor units considering capacities of the plurality of indoor units, and a length of an indoor unit pipe connected from a pump to each indoor unit, and maps the plurality of indoor units and a plurality of pumps based on the determined loads.

11 Claims, 12 Drawing Sheets

(56) References Cited

U.S. PATENT DOCUMENTS

| | | | | |
|---|---|---|---|---|
| 2016/0245561 | A1 | 8/2016 | Tanaka et al. | |
| 2017/0057619 | A1* | 3/2017 | Wilson | B64C 25/26 |
| 2020/0348064 | A1 | 11/2020 | Takenaka et al. | |

FOREIGN PATENT DOCUMENTS

| | | | | |
|---|---|---|---|---|
| CN | 101761992 | | 6/2010 | |
| CN | 204830360 | | 12/2015 | |
| CN | 105683683 | | 6/2016 | |
| CN | 109237644 | | 1/2019 | |
| EP | 3567256 | A1 * | 11/2019 | F04D 13/06 |
| JP | U H4-53127 | | 5/1992 | |
| JP | 2008-116163 | | 5/2008 | |
| JP | 2014-35090 | | 2/2014 | |
| KR | 10-2005-0075096 | | 7/2005 | |
| KR | 10-2005-0105736 | | 11/2005 | |
| KR | 10-1368456 | | 2/2014 | |
| KR | 10-2014-0104826 | | 8/2014 | |
| WO | WO 2019/155548 | | 8/2019 | |

OTHER PUBLICATIONS

Chinese Office Action dated Feb. 15, 2023 issued in Application No. 202080064621.X.

Japanese Office Action dated May 16, 2023 issued in Application No. 2022-522625.

European Search Report issued in Application No. 20916261.9 dated Jan. 23, 2024.

* cited by examiner

AIR CONDITIONING SYSTEM AND METHOD FOR CONTROLLING AIR CONDITIONING SYSTEM

CROSS-REFERENCE TO RELATED PATENT APPLICATIONS

This application is a U.S. National Stage Application under 35 U.S.C. § 371 of PCT Application No. PCT/KR2020/011420, filed Aug. 26, 2020, which claims priority to Korean Patent Application No. 10-2020-0010248, filed Jan. 29, 2020, whose entire disclosures are hereby incorporated by reference.

TECHNICAL FIELD

The present disclosure relates to an air conditioning system and a method for controlling the same.

BACKGROUND ART

An air conditioning apparatus is an apparatus for maintaining air in a predetermined space in the most suitable state according to the usage and purpose. Generally, the air conditioning apparatus includes a compressor, a condenser, an expansion device, and an evaporator. A refrigeration cycle that performs compression, condensation, expansion, and evaporation processes of a refrigerant is driven to cool or heat the predetermined space.

When the air conditioning apparatus performs a cooling operation, an outdoor heat exchanger provided in an outdoor unit functions as a condenser, and an indoor heat exchanger provided in an indoor unit functions as an evaporator. Meanwhile, when the air conditioning apparatus performs a heating operation, the indoor heat exchanger functions as a condenser, and the outdoor heat exchanger functions as an evaporator.

Recently, there has been a tendency to limit the type of refrigerant used in the air conditioning apparatus and reduce the amount of refrigerant used in accordance with the environmental regulation policy.

In order to reduce the amount of refrigerant used, a technique for performing cooling or heating by performing heat exchange between a refrigerant and a predetermined fluid has been proposed. For example, the predetermined fluid may include water.

US Patent Publication No. 2016-0245561 A1 (published date: Aug. 25, 2016, entitled "Refrigeration Cycle Mechanism) as the prior art document discloses an air conditioning apparatus that performs cooling or heating through heat exchange between a refrigerant and water.

Specifically, the air conditioning apparatus disclosed in the prior art document determines the capacity of a plurality of indoor units connected to a distributor and distributes loads to a plurality of pumps provided in the distributor, based on the determined capacity.

However, in the case of the above prior art document, the loads are distributed to the pumps considering only the capacity of the plurality of indoor units, and installation conditions for each indoor unit that may affect the loads of the pumps, for example, lengths of indoor unit pipes or pipe accessories, may not considered. Therefore, the loads may not be evenly distributed to the pumps.

DISCLOSURE OF INVENTION

Technical Problem

The present disclosure has been made in an effort to solve the above problems, and an object of the present disclosure is to provide an air conditioning system that is provided with a plurality of pumps to forcibly circulate water to a plurality of indoor units, wherein the load for each pump is evenly distributed considering installation conditions of the plurality of indoor units, thereby securing the load capability of the system and reducing the power consumption.

In addition, an object of the present disclosure is to provide an air conditioning system that is provided with a measurement device for measuring the capacity of circulating water for each indoor unit in order to evenly distribute the load of the pump, and determines the loads of the indoor units.

In another example, an object of the present disclosure is to provide an air conditioning system that is provided with a measurement device for measuring the power consumption for each indoor unit in order to evenly distribute the load of the pump, and determines the loads of the indoor units.

Furthermore, an object of the present disclosure is to provide an air conditioning system capable of determining ranks of indoor units by using values measured by the measurement device and mapping a plurality of pumps and a plurality of indoor units by using the determined ranks of the indoor units.

Solution to Problem

An air conditioning system according to an embodiment of the present disclosure may determine loads for each indoor unit considering the capacities of indoor units, length of an indoor unit pipe connected from a pump to the indoor unit, and the like, and may map a plurality of indoor units and a plurality of pumps based on the determined loads.

For example, a measurement device is provided to measure a flow rate of water circuiting the indoor unit when a pump is connected to a plurality of indoor units one by one and the pump is operated with a set output in order to determine loads for each indoor unit.

As another example, a measurement device is provided to measure power consumption of a pump when a pump is connected to a plurality of indoor units one by one and the pump is operated with a set output in order to determine loads for each indoor unit.

Based on the determined loads for each indoor unit, an indoor unit having a largest load and an indoor unit having a smallest load are mapped to a first pump, and indoor units having a middle load are mapped to a second pump, thereby evenly distributing the loads to the first and second pumps.

As a result, the capacity of water circulating the first pump and the capacity of water circulating the second pump are formed similarly. Therefore, the operation efficiency of the system is improved and the malfunction of the pump is prevented, thereby securing the durability of the system.

According to one aspect of the present disclosure, an air conditioning system includes an outdoor unit through which a refrigerant circulates, the outdoor unit including a compressor and an outdoor heat exchanger, a plurality of indoor units to which water is supplied, a heat exchanger configured to perform heat exchange between the refrigerant and the water, an indoor unit pipe connecting the heat exchanger to the indoor unit, the indoor unit pipe being configured to guide the circulation of the water in the heat exchanger and the indoor unit, a plurality of pumps installed in the indoor unit pipe to forcibly circulate the water, and an indoor unit load measurement device configured to, when the plurality of indoor units are mapped to the plurality of pumps, measure loads of the plurality of indoor units based on capacities of the plurality of indoor units and length of the indoor unit pipe.

The indoor unit load measurement device may be installed in the indoor unit pipe and may include a flow rate meter configured to measure a flow rate of water circulating the pump and the indoor unit.

The air conditioning system may further include a controller configured to determine the load of the indoor unit based on the flow rate measured by the flow rate meter.

The controller may be configured to determine ranks of flow rates measured for the plurality of indoor units and determine mapping of the plurality of pumps and the plurality of indoor units according to the determined ranks.

The controller may be configured to map, to a first pump, two indoor units corresponding to a highest rank and a lowest rank among the measured ranks of the flow rates, and map, to a second pump, two different indoor units corresponding to a middle rank among the measured ranks of the flow rates.

The flow rate meter may be provided with a plurality of flow rate meters, and the plurality of flow rate meters may be respectively installed in a plurality of indoor unit pipes connected to the plurality of indoor units.

The indoor unit load measurement device may include a power consumption meter electrically connected to the pump and configured to measure power consumption output by the pump.

The air conditioning system may further include a controller configured to determine the load of the indoor unit based on the power consumption measured by the power consumption meter, and the controller may be configured to determine ranks of power consumptions measured for the plurality of indoor units and determine mapping of the plurality of pumps and the plurality of indoor units according to the determined ranks.

The controller may be configured to map, to a first pump, two indoor units corresponding to a highest rank and a lowest rank among the measured ranks of the power consumptions, and map, to a second pump, two different indoor units corresponding to a middle rank among the measured ranks of the power consumptions.

The indoor unit pipe may be provided with a plurality of indoor unit pipes corresponding to the plurality of indoor units, and each of the plurality of indoor unit pipes may be provided with a valve configured to selectively allow supply of water to the plurality of indoor units.

According to another aspect of the present disclosure, a method for controlling an air conditioning system including an outdoor unit through which a refrigerant circulates, the outdoor unit including a compressor and an outdoor heat exchanger, a plurality of indoor units to which water is supplied, a heat exchanger configured to perform heat exchange between the refrigerant and the water, and a plurality of pumps configured to forcibly supply the water to the plurality of indoor units includes sequentially connecting one of the plurality of pumps to the plurality of indoor units and driving the pump.

The method may include determining loads of a plurality of indoor units measured when the pump is driven, and determining ranks for the determined loads of the plurality of indoor units, and mapping the plurality of indoor units and the plurality of pumps based on the ranks.

The determining of the loads of the plurality of indoor units may include measuring the loads of the plurality of indoor units by using an indoor unit load measurement device.

The indoor unit load measurement device may include a flow rate meter configured to measure an amount of water circulating the pump and the indoor unit, or a power consumption meter configured to measure power consumption of the pump.

The mapping of the plurality of indoor units and the plurality of pumps based on the ranks may include mapping, to the first pump, two indoor units corresponding to a highest rank and a lowest rank among the ranks of the loads of the plurality of indoor units, and mapping, to the second pump, two different indoor units corresponding to a middle rank among the ranks of the loads of the plurality of indoor units.

The plurality of indoor units may include first to fourth indoor units, and the plurality of pumps include first and second pumps, two indoor units corresponding to first and fourth ranks among the determined ranks may be mapped to the first pump, and two indoor units corresponding to second and third ranks may be mapped to the second pump.

According to another aspect of the present disclosure, an air conditioning system includes an outdoor unit through which a refrigerant circulates, a plurality of indoor units to which water is supplied, a heat exchanger configured to perform heat exchange between the refrigerant and the water, an indoor unit pipe connecting the heat exchanger to the indoor unit, a plurality of pumps installed in the indoor unit pipe to forcibly circulate the water, and an indoor unit load measurement device configured to measure loads of the plurality of indoor units when the plurality of indoor units are mapped to the plurality of pumps.

The indoor unit load measurement device may include a flow rate meter configured to measure a flow rate of water circulating the pump and the indoor unit, or a power consumption meter configured to measure power consumption output by the pump.

The air conditioning system may further include a controller configured to determine ranks of the measured loads for the plurality of indoor units, and the controller may be configured to determine mapping of the plurality of pumps and the plurality of indoor units according to the determined ranks.

The controller may be configured to map, to a first pump, two indoor units corresponding to a highest rank and a lowest rank among the measured ranks of the loads, and map, to a second pump, two different indoor units corresponding to a middle rank among the measured ranks of the loads.

Advantageous Effects of Invention

According to the air conditioning system according to the embodiment of the present disclosure has the following effects.

First, the load per pump may be evenly distributed considering installation conditions of a plurality of indoor units, and thus, it is possible to secure the load capacity of the system and reduce power consumption.

Second, as an example, a measurement device that measures the capacity of circulating water for each indoor unit is provided to determine loads of indoor units. The loads of the indoor units are determined considering not only the capacity of the indoor unit but also the length of the indoor unit pipe and the installation situation of the pipe accessories, thereby evenly distributing the loads of the pumps.

As another example, a measuring device that measures power consumption for each indoor unit is provided to measure loads of indoor units, thereby evenly distributing loads of pumps.

Third, the ranks of the indoor units are determined by using the values measured by the measurement device, and a plurality of pumps and a plurality of indoor units may mapped by using the determined ranks of the indoor units, thereby evenly distributing the loads applied to the pumps.

MODE FOR THE INVENTION

Figure 1:
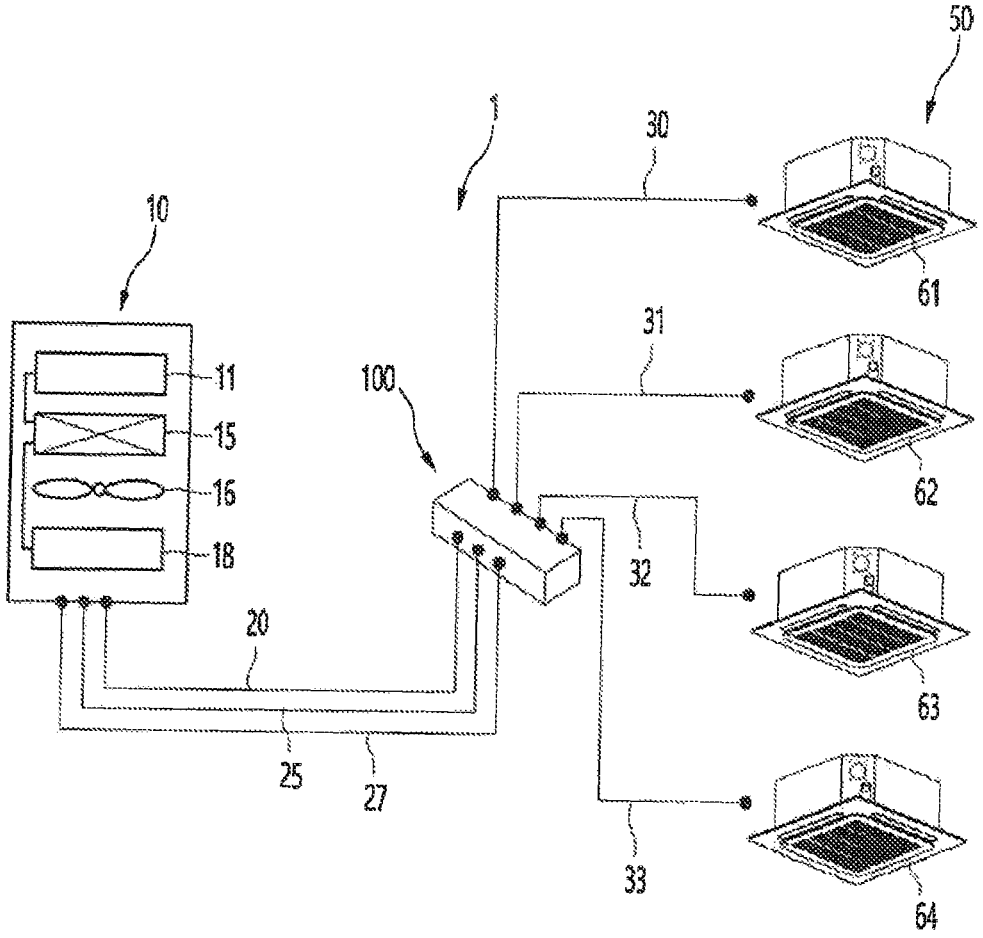
FIG. 1 is a schematic diagram illustrating an air conditioning apparatus according to an embodiment of the present disclosure.

Hereinafter, embodiments of the present disclosure will be described in detail with reference to the drawings. It should be noted that, in adding reference numerals to the components of each drawing, the same components are denoted by the same reference numerals even though they are shown in different drawings. In describing the present disclosure, when the detailed description of the relevant functions or configurations is determined to unnecessarily obscure the gist of the disclosure, the detailed description may be omitted.

In describing the components of the embodiments of the present disclosure, the terms such as first, second, A, B, (a), and (b) may be used. These terms are only used for distinguishing a component from another, and the nature, order, or sequence of the components is not limited by these terms. When a component is described as being "connected" or "coupled" to another component, it should be understood that the component may be directly connected or coupled to the other component, but another component may be "connected" or "coupled" between the components.

Figure 2:
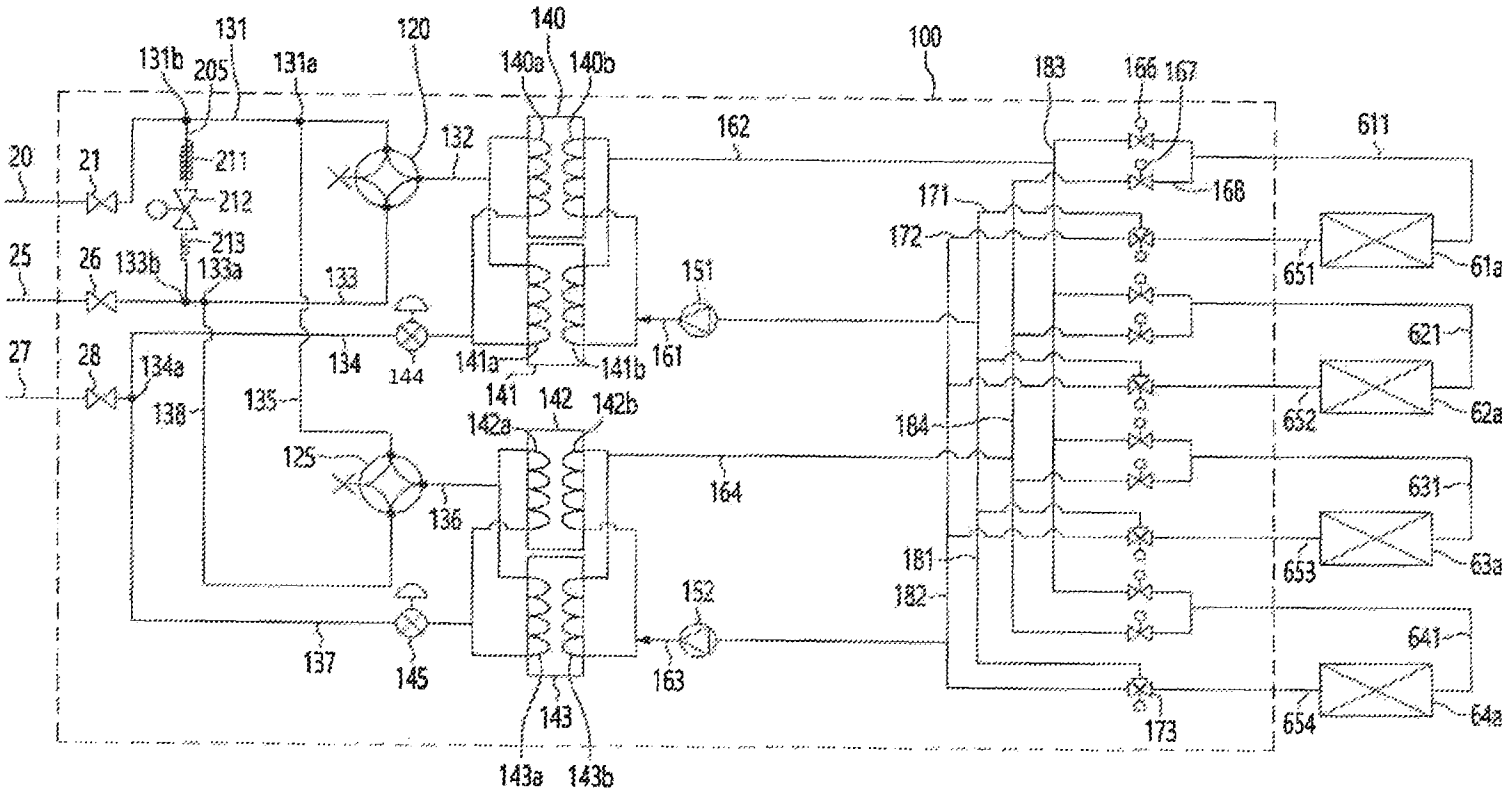
FIG. 2 is a cycle diagram illustrating the configuration of the air conditioning apparatus according to an embodiment of the present disclosure.

FIG. 1 is a schematic diagram illustrating an air conditioning apparatus according to an embodiment of the present disclosure, and FIG. 2 is a cycle diagram illustrating the configuration of the air conditioning apparatus according to an embodiment of the present disclosure.

Referring to FIGS. 1 and 2, the air conditioning apparatus 1 according to an embodiment of the present disclosure may include an outdoor unit 10, an indoor unit 50, and a heat exchange device 100 connected to the outdoor unit 10 and the indoor unit 50.

The outdoor unit 10 and the heat exchange device 100 may be fluidly connected by a first fluid. In one example, the first fluid may include a refrigerant.

The refrigerant may flow through the outdoor unit 10 and a refrigerant-side passage of a heat exchanger provided in the heat exchange device 100.

The outdoor unit 10 may include a compressor 11 and an outdoor heat exchanger 15.

An outdoor fan 16 is provided on one side of the outdoor heat exchanger 15 to blow outside air toward the outdoor heat exchanger 15, and the outdoor fan 16 may be driven to perform heat exchange between the outside air and the refrigerant of the outdoor heat exchanger 15.

The outdoor unit 10 may further include an electronic expansion valve (EEV) 18.

The air conditioning apparatus 1 may further include connecting pipes 20, 25, and 27 connecting the outdoor unit 10 to the heat exchange device 100.

The connecting pipes 20, 25, and 27 may include a first outdoor unit connecting pipe 20 as a gas pipe (high pressure gas pipe) through which a high pressure gas refrigerant flows, a second outdoor unit connecting pipe 25 as a gas pipe (low pressure gas pipe) through which a low pressure gas refrigerant flows, and a third outdoor unit connecting pipe 27 as a liquid pipe through which a liquid refrigerant flows.

That is, the outdoor unit 10 and the heat exchange device 100 have a "three-pipe connection structure", and the three connecting pipes 20, 25, and 27 may cause the refrigerant to circulate through the outdoor unit 10 and the heat exchange device 100.

The heat exchange device 100 and the indoor unit 50 may be fluidly connected by a second fluid. In one example, the second fluid may include water.

The water may flow through the indoor unit 50 and a water-side passage of a heat exchanger provided in the heat exchange device 100.

The heat exchange device 100 may include a plurality of heat exchangers 140, 141, 142, and 143. The heat exchanger may include, for example, a plate heat exchanger.

The indoor unit 50 may include a plurality of indoor units 61, 62, 63, and 64.

In the present embodiment, it is noted that there is no limitation to the number of indoor units 61, 62, 63, and 64.

In FIG. 1, for example, four indoor units 61, 62, 63, and 64 are illustrated as being connected to the heat exchange device 100.

The plurality of indoor units 61, 62, 63, and 64 may include a first indoor unit 61, a second indoor unit 62, a third indoor unit 63, and a fourth indoor unit 64.

The air conditioning apparatus 1 may further include pipes 30, 31, 32, and 33 connecting the heat exchange device 100 to the indoor unit 50. The pipes 30, 31, 32, and 33 may be provided with water pipes through which water flows.

The pipes 30, 31, 32, and 33 may include a first indoor unit connecting pipe 30, a second indoor unit connecting pipe 31, a third indoor unit connecting pipe 32, and a fourth indoor unit connecting pipe connecting the heat exchange device 100 to the indoor units 61, 62, 63, and 64.

Water may circulate through the heat exchange device 100 and the indoor unit 50 through the indoor unit connecting pipes 30, 31, 32, and 33. When the number of indoor units increases, the number of pipes connecting the heat exchange device 100 to the indoor units increases.

With this configuration, the refrigerant circulating through the outdoor unit 10 and the heat exchange device 100 and the water circulating through the heat exchange device 100 and the indoor unit 50 exchange heat through the heat exchangers 140, 141, 142, and 143 provided in the heat exchange device 100.

The water cooled or heated through the heat exchange may exchange heat with the indoor heat exchangers 61*a*, 62*a*, 63*a*, and 64*a* provided in the indoor unit 50 to cool or heat the indoor space.

The plurality of heat exchangers 140, 141, 142, and 143 may be provided in the same number as the number of the plurality of indoor units 61, 62, 63, and 64. Alternatively, two or more indoor units may be connected to one heat exchanger.

Hereinafter, the heat exchange device 100 will be described in more detail with reference to the accompanying drawings.

The heat exchange device 100 may include the first to fourth heat exchangers 140, 141, 142, and 143 fluidly connected to the indoor units 61, 62, 63, and 64, respectively.

The first to fourth heat exchangers 140, 141, 142, and 143 may have the same structure.

The heat exchangers 140, 141, 142, and 143 may each include, for example, a plate heat exchanger, and may be configured such that the water and the refrigerant passage are alternately stacked.

The heat exchangers 140, 141, 142, and 143 may include refrigerant passages 140*a*, 141*a*, 142*a*, and 143*a* and water passages 140*b*, 141*b*, 142*b*, and 143*b*, respectively.

The refrigerant passage 140*a*, 141*a*, 142*a*, and 143*a* are fluidly connected to the outdoor unit 10. The refrigerant discharged from the outdoor unit 10 may be introduced into the refrigerant passages 140*a*, 141*a*, 142*a*, and 143*a*, or the refrigerant having passed through the refrigerant passages 140*a*, 141*a*, 142*a*, and 143*a* may be introduced into the outdoor unit 10.

The water passages 140*b*, 141*b*, 142*b*, and 143*b* are connected to the indoor units 61, 62, 63, and 64, respectively. The water discharged from the indoor units 61, 62, 63, and 64 may be introduced into the water passages 140*b*, 141*b*, 142*b*, and 143*b*, and the water having passed through the water passages 140*b*, 141*b*, 142*b*, and 143*b* may be introduced into the indoor units 61, 62, 63, and 64.

The heat exchange device 100 may include a first connecting pipe 131 connected to the first outdoor unit connecting pipe 20 through a first service valve 21. The first connecting pipe 131 may extend into the heat exchange device 100 and may be connected to a first port of a first valve device 120.

The heat exchange device 100 may include a third connecting pipe 133 connected to the second outdoor unit connecting pipe 25 through a second service valve 26. The third connecting pipe 133 may extend into the heat exchange device 100 and may be connected to a third port of the first valve device 120.

The heat exchange device 100 may include a fourth connecting pipe 134 connected to the third outdoor unit connecting pipe 27 through a third service valve 28. The fourth connecting pipe 134 may extend into the heat exchange device 100 and may be connected to the first heat exchanger 140 and the second heat exchanger 141.

The heat exchange device 100 may include a seventh connecting pipe 137 connected to the third outdoor unit connecting pipe 27 through the third service valve 28. The seventh connecting pipe 137 may extend into the heat exchange device 100 and may be connected to the third heat exchanger 142 and the fourth heat exchanger 143.

The seventh connecting pipe 137 may extend from a third branch portion 134*a* of the fourth connecting pipe 134 and may be connected to the third heat exchanger 142 and the fourth heat exchanger 143. That is, the fourth connecting pipe 134 and the seventh connecting pipe 137 may be pipes branched from pipes extending from the third service valve 28.

The first to third outdoor unit connecting pipes 20, 25 and 27 may be connected to the heat exchange device 100 through the first to third service valves 21, 26, and 28, such that the outdoor unit 10 and the heat exchange device 100 form the "three-pipe connection".

The first heat exchanger 140 may include the first refrigerant passage 140*a* and the first water passage 140*b*. One side of the first refrigerant passage 140*a* may be connected to the second connecting pipe 132. The second connecting pipe 132 may extend from the second port of the first valve device 120 and may be connected to the first heat exchanger 140 and the second heat exchanger 141.

The other side of the first refrigerant passage 140*a* may be connected to the fourth connecting pipe 134. The fourth connecting pipe 134 may extend from the third service valve 28 and may be connected to the first heat exchanger 140 and the second heat exchanger 141. That is, both sides of the first refrigerant passage 140*a* may be connected to the second connecting pipe 132 and the fourth connecting pipe 134.

The second heat exchanger 141 may include the second refrigerant passage 141*a* and the second water passage 141*b*. One side of the second refrigerant passage 141*a* may be connected to the second connecting pipe 132. The second connecting pipe 132 may be branched and connected to the first heat exchanger 140 and the second heat exchanger 141.

The other side of the second refrigerant passage 141*a* may be connected to the fourth connecting pipe 134. Both sides of the second refrigerant passage 141*a* may be connected to the second connecting pipe 132 and the fourth connecting pipe 134. The fourth connecting pipe 134 may be branched and connected to the first heat exchanger 140 and the second heat exchanger 141.

The refrigerant discharged from the outdoor unit 10 may be introduced into the first refrigerant passage 140*a* and the second refrigerant passage 141*a* through the first connecting pipe 131 and the first valve device 120, and the refrigerant having passed through the first refrigerant passage 140*a* and the second refrigerant passage 141*a* may be introduced into the outdoor unit 10 through the fourth connecting pipe 134.

The third heat exchanger 142 may include the third refrigerant passage 142*a* and the third water passage 142*b*. One side of the third refrigerant passage 142*a* may be connected to the sixth connecting pipe 136. The sixth connecting pipe 136 may extend from the second port of the second valve device 125 and be connected to the third heat exchanger 142 and the fourth heat exchanger 143.

The other side of the third refrigerant passage 142*a* may be connected to the seventh connecting pipe 137. The seventh connecting pipe 137 may extend from the third service valve 28 and may be connected to the third heat exchanger 142 and the fourth heat exchanger 143. That is, both sides of the third refrigerant passage 142*a* may be connected to the sixth connecting pipe 136 and the seventh connecting pipe 137.

The fourth heat exchanger 143 may include the fourth refrigerant passage 143*a* and the fourth water passage 143*b*. One side of the fourth refrigerant passage 143*a* may be connected to the sixth connecting pipe 136. The sixth connecting pipe 136 may be branched and connected to the third heat exchanger 142 and the fourth heat exchanger 143.

The other side of the fourth refrigerant passage 143*a* may be connected to the seventh connecting pipe 137. Both sides of the fourth refrigerant passage 143*a* may be connected to the sixth connecting pipe 136 and the seventh connecting pipe 137. The seventh connecting pipe 137 may be branched and connected to the third heat exchanger 142 and the fourth heat exchanger 143.

The refrigerant discharged from the outdoor unit 10 may be introduced into the third refrigerant passage 142*a* and the fourth refrigerant passage 143*a* through the first connecting pipe 131 and the second valve device 125, and the refrigerant having passed through the third refrigerant passage 142*a* and the fourth refrigerant passage 143*a* may be introduced into the outdoor unit 10 through the seventh connecting pipe 137.

A first branch portion 131*a* may be formed in the first connecting pipe 131.

The heat exchange device 100 may further include a fifth connecting pipe 135 connected to the first branch portion 131*a* and extending to the second valve device 125. The fifth connecting pipe 135 may be connected to a first port of the second valve device 125.

A second branch portion 133*a* may be formed in the third connecting pipe 133.

The heat exchange device 100 may further include an eighth connecting pipe 138 connected to the second branch portion 133*a* and extending to the second valve device 125. The eighth connecting pipe 138 may be connected to a third port of the second valve device 125.

The heat exchange device 100 may include a first valve device 120 and a second valve device 125 that control the flow direction of the refrigerant. The first valve device 120 and the second valve device 125 may be provided with four-way valves or three-way valves. Hereinafter, a case in which the first valve device 120 and the second valve device 125 are provided with four-way valves will be described.

The first valve device 120 may include a first port to which the first connecting pipe 131 is connected, a second port to which the second connecting pipe 132 is connected, and a third port to which the third connecting pipe 133 is connected. A fourth port of the first valve device 120 may be closed.

The second valve device 125 may include a first port to which the fifth connecting pipe 135 is connected, a second port to which the sixth connecting pipe 136 is connected, and a third port to which the eighth connecting pipe 138 is connected. A fourth port of the second valve device 125 may be closed.

The heat exchange device 100 may further include expansion valves 144 and 145 for depressurizing the refrigerant. The expansion valves 144 and 145 may include an electronic expansion valve (EEV).

The expansion valves 144 and 145 may decrease the pressure of the refrigerant passing through the expansion valves 144 and 145 through opening control. For example, when the electronic expansion valves 144 and 145 are fully opened (full-open state), the refrigerant can pass without depressurization, and when the opening degree of the expansion valves 140 and 145 decreases, the refrigerant may be depressurized. The degree of depressurization of the refrigerant increases as the opening degree decreases.

In detail, the expansion valves 144 and 145 may include a first expansion valve 144 installed in the fourth connecting pipe 134. The first expansion valve 144 may be installed at one point of the fourth connecting pipe 134 between the third service valve 38 and the first refrigerant passage 140*a* or the second refrigerant passage 141*a*.

The expansion valves 144 and 145 may further include a second expansion valve 145 installed in the seventh connecting pipe 137.

The heat exchange device 100 may further include a bypass pipe 205 connecting the first connecting pipe 131 to the third connecting pipe 133.

The bypass pipe 205 may be understood as a pipe for preventing liquid refrigerant from being accumulated in a high pressure gas pipe during a cooling operation. One end of the bypass pipe 205 may be connected to a first bypass branch portion 131*b* of the first connecting pipe 131, and the other end of the bypass pipe 205 may be connected to a second bypass branch portion 133*b* of the third connecting pipe 133.

Based on the first connecting pipe 131, the first branch portion 131*a* may be formed at one point between the first bypass branch portion 131*b* and the first port of the first valve device 120.

Based on the first connecting pipe 131, the first bypass branch portion 131*b* may be formed at one point between the first service valve 21 and the first branch portion 131*a*.

Based on the third connecting pipe 133, the second branch portion 133*a* may be formed at one point between the second bypass branch portion 133*b* and the third port of the first valve device 120.

Based on the third connecting pipe 133, the second bypass branch portion 133*b* may be formed at one point between the second service valve 26 and the second branch portion 133*a*.

The bypass pipe 205 may be provided with a bypass valve 212 that controls opening and closing of the pipe. For example, the bypass valve 212 may include a two-way valve or a solenoid valve having a relatively low pressure loss.

The bypass pipe 205 may be provided with a strainer 211 for filtering wastes in the refrigerant flowing through the pipe. In one example, the strainer 211 may be made of a metal mesh. The strainer 211 may be disposed at one point between the bypass valve 212 and the first bypass branch portion 131*b*.

The bypass pipe 205 may further include an expansion device 213 for depressurizing the refrigerant flowing through the pipe. In one example, the expansion device 213 may be configured as a capillary tube using a capillary phenomenon.

The expansion device 213 may be disposed at one point between the bypass valve 212 and the second bypass branch portion 133*b*. Therefore, the pressure of the refrigerant passing through the expansion device 213 may drop.

The heat exchange device 100 may further include a heat exchanger inlet pipe and a heat exchanger outlet pipe connected to the water passages 140*b*, 141*b*, 142*b*, and 143*b* of the heat exchangers 140, 141, 142, and 143.

A first heat exchanger inlet pipe of the first heat exchanger 140 and a second heat exchanger inlet pipe of the second heat exchanger 141 may be branched from a first common inlet pipe 161. A first pump 151 may be provided in the first common inlet pipe 161.

A third heat exchanger inlet pipe of the third heat exchanger 142 and a fourth heat exchanger inlet pipe of the fourth heat exchanger 143 may be branched from a second common inlet pipe 163. A second pump 152 may be provided in the second common inlet pipe 163.

A first heat exchanger outlet pipe of the first heat exchanger 140 and a second heat exchanger outlet pipe of the second heat exchanger 141 may be branched from a first common outlet pipe 162.

A third heat exchanger outlet pipe of the third heat exchanger 142 and a fourth heat exchanger outlet pipe of the fourth heat exchanger 143 may be branched from a second common outlet pipe 164.

A first joint pipe 181 may be connected to the first common inlet pipe 161. A second joint pipe 182 may be connected to the second common inlet pipe 163.

A third joint pipe 183 may be connected to the first common outlet pipe 162. A fourth joint pipe 184 may be connected to the second common outlet pipe 164.

A first water discharge pipe 171 through which water discharged from the indoor heat exchangers 61*a*, 62*a*, 63*a*, and 64*a* flows may be connected to the first joint pipe 181. The first water discharge pipe 171 may be branched to four pipes from the first joint pipe 181 in correspondence to the first to fourth indoor units and may be connected to the first to fourth indoor units.

A second water discharge pipe 172 through which water discharged from the indoor heat exchangers 61*a*, 62*a*, 63*a*, and 64*a* flows may be connected to the second joint pipe 182. The second water discharge pipe 172 may be branched to four pipes from the second joint pipe 182 in correspondence to the first to fourth indoor units and may be connected to the first to fourth indoor units.

The first water discharge pipe 171 and the second water discharge pipe 172 may be disposed in parallel and may be connected to common water outlet pipes 651, 652, 653, and 654 communicating with the indoor heat exchangers 61*a*, 62*a*, 63*a*, and 64*a*.

The first water discharge pipe 171, the second water discharge pipe 172, and the common water outlet pipe 651, 652, 653, and 654 may be connected by, for example, a three-way valve 173.

Therefore, due to the three-way valve 173, the water of the common water outlet pipes 651, 652, 653, and 654 can flow through one of the first water discharge pipe 171 and the second water discharge pipe 172.

The common water outlet pipes 651, 652, 653, and 654 may be connected to the discharge pipes of the indoor heat exchangers 61*a*, 62*a*, 63*a*, and 64*a*.

The third joint pipe 183 may be branched into a plurality of pipes corresponding to the first to fourth indoor units, and water to be introduced into the indoor heat exchangers 61*a*, 62*a*, 63*a*, and 64*a* may flow therethrough. The third joint pipe 183 may be referred to as a "first indoor unit pipe".

The third joint pipe 184 may be branched into a plurality of pipes corresponding to the first to fourth indoor units, and water to be introduced into the indoor heat exchangers 61*a*, 62*a*, 63*a*, and 64*a* may flow therethrough. The fourth joint pipe 184 may be referred to as a "second indoor unit pipe".

The plurality of third joint pipes 183 and the plurality of fourth joint pipes 184 may be disposed in parallel and may be connected to common water inlet pipes 611, 621, 631, and 641 communicating with the indoor heat exchangers 61*a*, 62*a*, 63*a*, and 64*a*.

A first valve 166 may be provided in the third joint pipe 183, and a second valve 167 may be provided in the fourth joint pipe 184. For example, the first valve 166 and the second valve 167 may be configured as a solenoid valve capable of on/off control.

When the first pump 151 is driven, if the first valve 166 is opened, water discharged from the first pump 151 may be branched through the plurality of third joint pipes 183 and flow into the indoor units (first to fourth indoor units). The first valve 166 may be referred to as a "first indoor unit valve".

When the second pump 152 is driven, if the second valve 167 is opened, water discharged from the second pump 152 may be branched through the plurality of fourth joint pipes 184 and flow into the indoor units (first to fourth indoor units). The second valve 167 may be referred to as a "second indoor unit valve".

For convenience of description, the first heat exchanger 140 and the second heat exchanger 141 may be referred to as a "first-side heat exchanger". In addition, the third heat exchanger 142 and the fourth heat exchanger 143 may be referred to as a "second-side heat exchanger".

Figure 3:
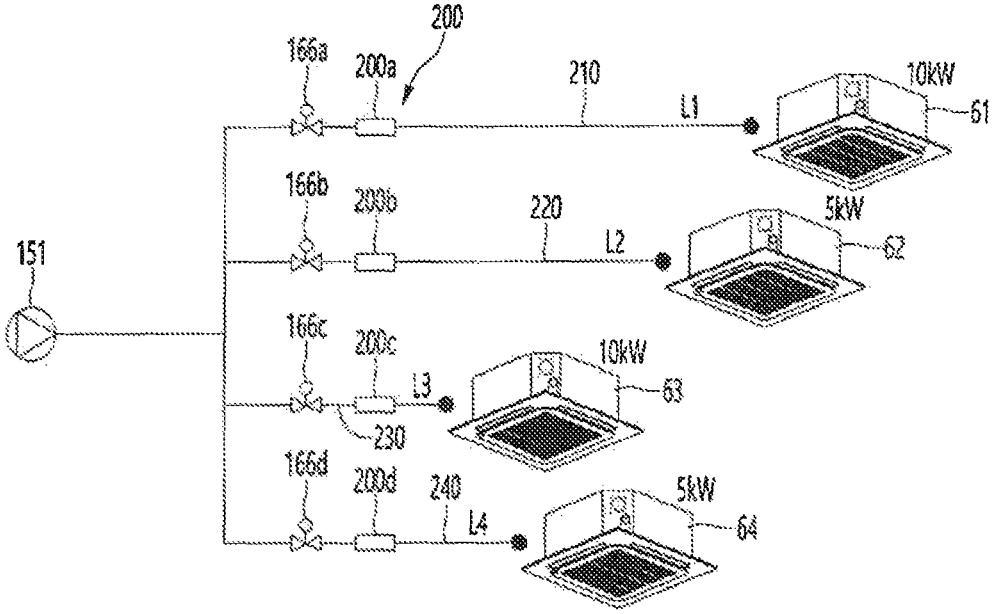
FIG. 3 is a schematic diagram illustrating a connection configuration between a first pump and a plurality of indoor units according to a first embodiment of the present disclosure.

FIG. 3 is a schematic diagram illustrating a connection configuration between a first pump and a plurality of indoor units, according to a first embodiment of the present disclosure.

Referring to FIG. 3, when an air conditioning system 1 according to an embodiment of the present disclosure is installed and then performs a test drive, a first pump 151 may be driven so as to determine loads of a plurality of indoor units, and the amount of water flowing through the first pump 151 and the indoor units may be determined. Instead of the first pump 151, a second pump 152 may be driven and the amount of water flowing through the second pump 152 and the indoor units may be determined.

FIG. 3 is a diagram schematically illustrating the connection structure of the first pump 151 and the first to fourth indoor units 61, 62, 63, and 64. The first pump 151 may be connected to the first to fourth indoor units 61, 62, 63, and 64 through an indoor unit pipe. For convenience of explanation, the indoor unit pipe is a pipe extending from a heat exchange device 100 to first to fourth indoor unit pipes, and may be understood as a pipe in which a first common inlet pipe 161, a first common outlet pipe 162, and a third joint pipe 183 are combined.

The indoor unit pipe 183 includes a first indoor unit pipe 210 connected to the first indoor unit 61, a second indoor unit pipe 220 connected to the second indoor unit 62, a third indoor unit pipe 230 connected to the third indoor unit 63, and a fourth indoor unit pipe 240 connected to the fourth indoor unit 64.

The length of the first indoor unit pipe 210 may be a first length L1, the length of the second indoor unit pipe 220 may be a second length L2, the length of the third indoor unit pipe 230 may be a third length L3, and the length of the fourth indoor unit pipe 240 may be a fourth length L4.

For example, the first length L1 may be 60 m, the second length L2 may be 40 m, the third length L3 may be 10 m, and the fourth length L4 may be 20 m.

The first to fourth indoor units 61, 62, 63, and 64 may have different capacities. For example, the capacity of the first indoor unit 61 may be 10 kw, the capacity of the second indoor unit 62 may be 5 kw, the capacity of the third indoor unit 63 may be 10 kw, and the capacity of the fourth indoor unit 64 may be 5 kw The first valve 166 described above is installed in the indoor unit pipe 183. In detail, the first valve 166 includes a first indoor unit valve 166*a* installed in the first indoor unit pipe 210, a second indoor unit valve 166*b* installed in the second indoor unit pipe 220, a third indoor unit valve 166*c* installed in the third indoor unit pipe 230, and a fourth indoor unit valve 166*d* installed in the fourth indoor unit pipe 240.

A flow rate meter 200 may be installed in the first to fourth indoor unit pipes 210, 220, 230, and 240. In detail, the flow rate meter 200 may include first to fourth flow rate meters 200*a*, 200*b*, 200*c*, and 200*d*. The first to fourth flow rate meters 200*a*, 200*b*, 200*c*, and 200*d* may measure the amount of water flowing to the first to fourth indoor units 61, 62, 63 and 64, respectively.

Under these installation conditions, the first pump 151 and the first to fourth indoor units 61, 62, 63, and 64 are sequentially connected one by one, and the first pump 151 may be driven to determine the amount of water measured by the flow rate meter. In this case, the amount of water may be understood as a result of reflecting installation conditions such as the capacity of the indoor unit, the length of the indoor unit pipe, and accessories of the indoor unit pipe. Hereinafter, such a measurement method will be described in detail with reference to the drawings.

Figure 4A:
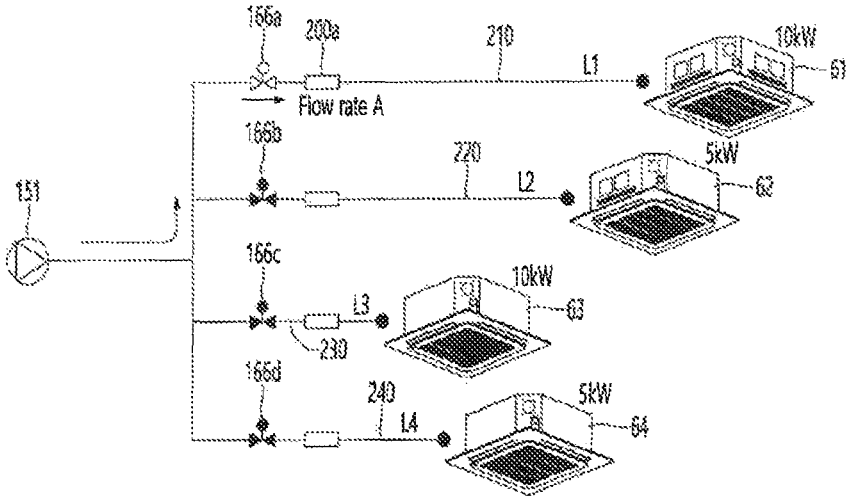
FIGS. 4A to 4D are schematic diagrams illustrating a state in which the first pump and the plurality of indoor units according to the first embodiment of the present disclosure are sequentially connected one by one to measure a flow rate of an indoor unit pipe.
Figure 4B:
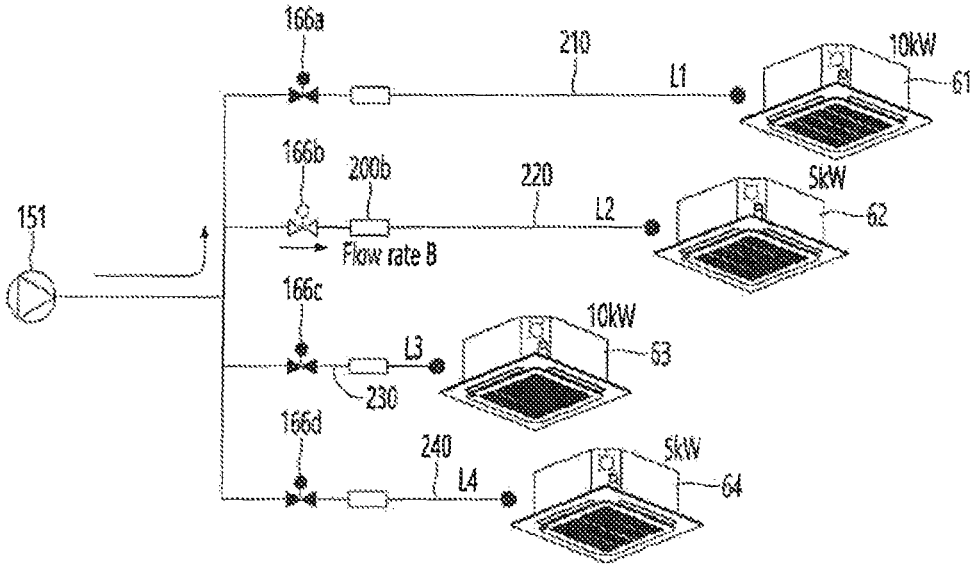
Figure 4C:
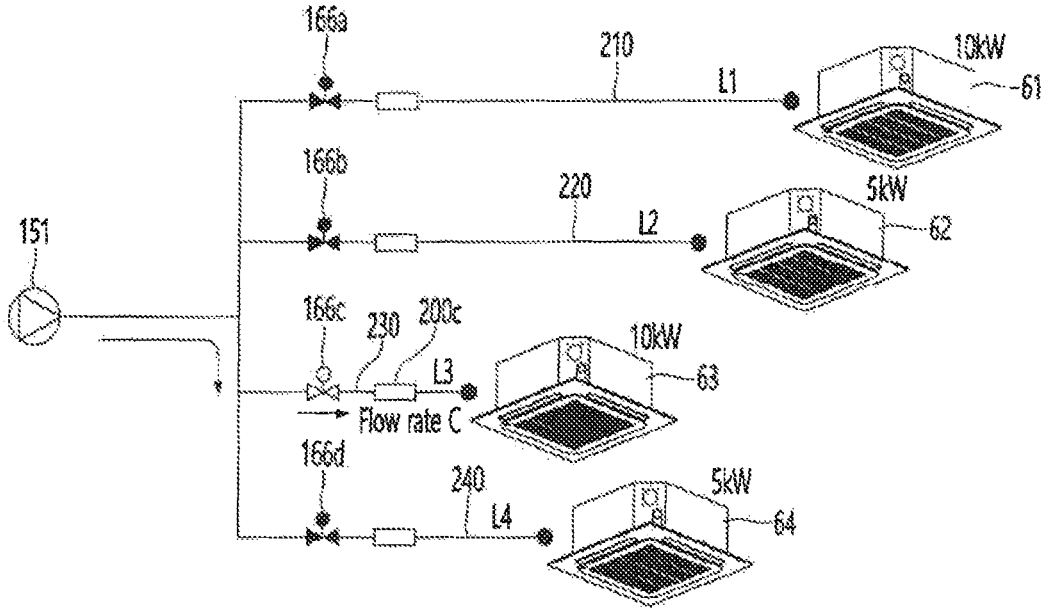
Figure 4D:
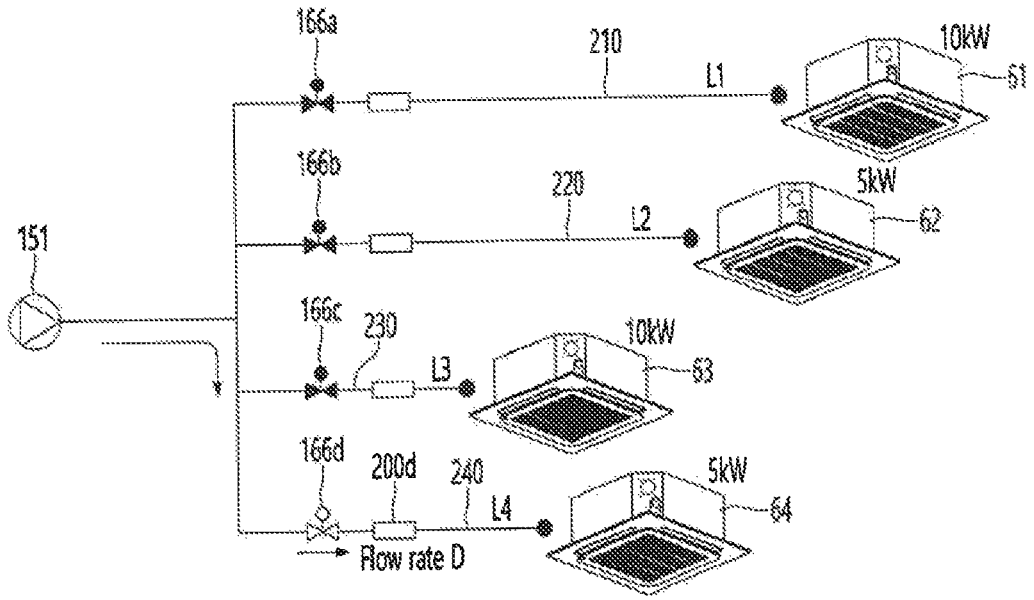
Figure 5:
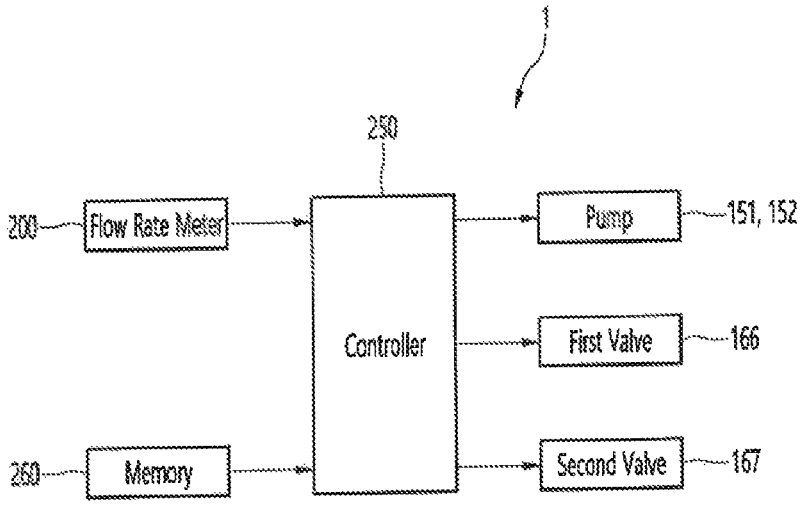
FIG. 5 is a block diagram illustrating a configuration of an air conditioning system according to the first embodiment of the present disclosure.
Figure 6:
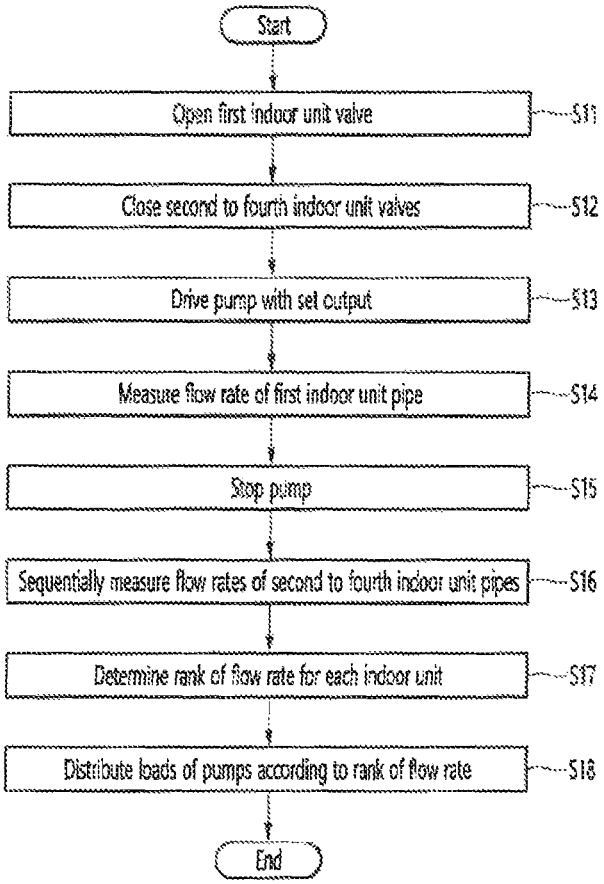
FIG. 6 is a flowchart illustrating a method for controlling an air conditioning system according to the first embodiment of the present disclosure.

FIGS. 4*a* to 4*d* are schematic diagrams illustrating a state in which the first pump and the plurality of indoor units according to the first embodiment of the present disclosure are sequentially connected one by one to measure the flow rate of the indoor unit pipe, FIG. 5 is a block diagram illustrating a configuration of an air conditioning system according to the first embodiment of the present disclosure, and FIG. 6 is a flowchart illustrating a method for controlling an air conditioning system according to the first embodiment of the present disclosure.

A method for determining the load of the indoor unit according to the first embodiment of the present disclosure will be described with reference to FIGS. 4A to 4D and FIGS. 5 and 6 together.

First, as illustrated in FIG. 4*a*, a controller 250 opens the first indoor unit valve 166*a* and closes the second to fourth indoor unit valves 166*b*, 166*c*, and 166*d* (S11, S12).

The first pump 151 is driven with a set output. For example, the set output may be the maximum output of the first pump 151 (S13).

When the first pump 151 is driven, water discharged from the first pump 151 flows through the first indoor unit pipe 210, and the flow through the second to fourth indoor unit pipes 220, 230, and 240 may be limited.

The water passes through the first flow rate meter 200*a*, and in this process, the amount of water flowing through the first indoor unit pipe 210 may be measured (S14).

Such measurement may be made for a set time, and after that, the controller 250 stops driving the first pump 151. The measured amount of water is stored in a memory 260, and this may be determined as the load of the first indoor unit 61 (S15).

In this way, the loads of the second to fourth indoor units 62, 63 and 64 may be sequentially determined.

That is, in order to determine the load of the second indoor unit 62, as illustrated in FIG. 4*b*, the controller 250 opens the second indoor unit valve 166*b* and closes the first, third, and fourth indoor unit valves 166*a*, 166*c*, and 166*d*.

When the first pump 151 is driven with a set output, water discharged from the first pump 151 flows through the second indoor unit pipe 220, and the flow through the first, third, and fourth indoor unit pipes 210, 230, and 240 may be limited.

The water passes through the second flow rate meter 200*b*, and in this process, the amount of water flowing through the second indoor unit pipe 220 may be measured. The measured amount of water is stored in the memory 260, and this may be determined as the load of the second indoor unit 62.

Similarly, in order to determine the load of the third indoor unit 63, as illustrated in FIG. 4*c*, the controller 250 opens the third indoor unit valve 166*c* and closes the first, second, and fourth indoor unit valves 166*a*, 166*b*, and 166*d*.

When the first pump 151 is driven with a set output, water discharged from the first pump 151 flows through the third indoor unit pipe 230, and the flow through the first, second, and fourth indoor unit pipes 210, 220, and 240 may be limited.

The water passes through the third flow rate meter 200*c*, and in this process, the amount of water flowing through the third indoor unit pipe 230 may be measured. The measured amount of water is stored in the memory 260, and this may be determined as the load of the third indoor unit 63.

Finally, in order to determine the load of the fourth indoor unit 64, as illustrated in FIG. 4*d*, the controller 250 opens the fourth indoor unit valve 166*d* and closes the first, second, and third indoor unit valves 166*a*, 166*b*, and 166*c*.

When the first pump 151 is driven with a set output, water discharged from the first pump 151 flows through the fourth indoor unit pipe 240, and the flow through the first, second, and third indoor unit pipes 210, 220, and 230 may be limited.

The water passes through the fourth flow rate meter 200*d*, and in this process, the amount of water flowing through the fourth indoor unit pipe 240 may be measured. The measured amount of water is stored in the memory 260, and this may be determined as the load of the fourth indoor unit 64.

For example, the measured amount of water may change little by little over time, and the maximum value among the measured values may be determined as the amount of water (S16).

In the above-described method, the amount of water flowing through the first to fourth indoor units is measured, and the rank of the flow rate for each indoor unit is determined. The rank of the flow rate may correspond to the load rank for each indoor unit. According to the rank of the flow rate, mapping information of the first and second pumps 151 and 152 and the first to fourth indoor units 61, 62, 63 and 64 is determined, and the loads of the first and second pumps are equally distributed (S17, S18).

FIG. 6 illustrates the mapping result of the first and second pumps 151 and 152 with respect to the first to fourth indoor units 61, 62, 63, and 64. Details will be described in detail with reference to FIG. 7.

Figure 7:
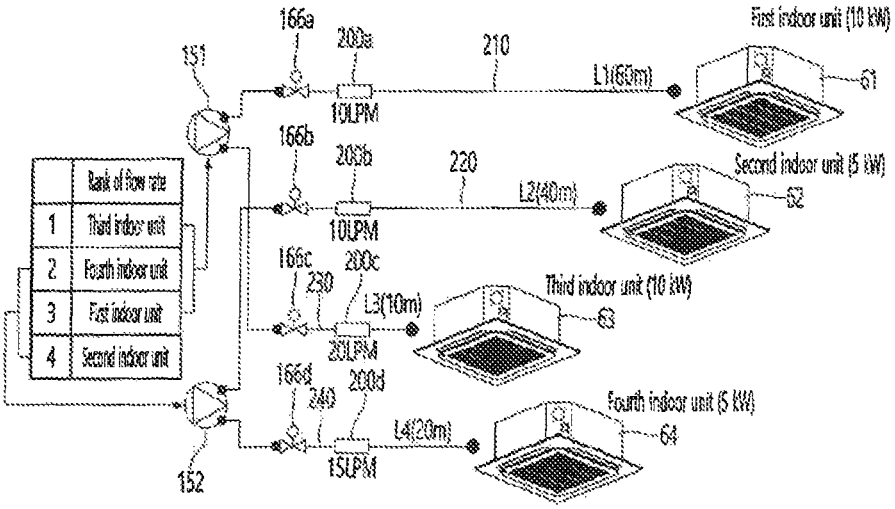
FIG. 7 is a schematic diagram illustrating a result of mapping a plurality of pumps and a plurality of indoor units according to the first embodiment of the present disclosure.

FIG. 7 is a schematic diagram illustrating a result of mapping a plurality of pumps and a plurality of indoor units according to the first embodiment of the present disclosure.

Referring to FIG. 7, after the pump for each indoor unit is operated, the water flow rate of each indoor unit pipe may be measured through the flow rate meter. It may be determined that as the flow rate of water flowing through the indoor unit pipe increases, the load of the indoor unit is small, and as the flow rate of water decreases, the load of the indoor unit is large.

As a result of the measuring, for example, the flow rate of water flowing through the first indoor unit pipe 210 may be 10 LPM (Liters Per Minute), the flow rate of water flowing through the second indoor unit pipe 220 may be 10 LPM, the flow rate of water flowing through the third indoor unit pipe 230 may be 20 LPM, and the flow rate of water flowing through the fourth indoor unit pipe 240 may be 15 LPM.

Therefore, the water flow rate of the third indoor unit 63 may be rank 1, the water flow rate of the fourth indoor unit 64 may be rank 2, the water flow rate of the first indoor unit 61 may be rank 3, and the water flow rate of the second indoor unit 62 may be rank 4.

Based on the rank of the flow rate, ranks 1 and 3 may be mapped to one of the first and second pumps 151 and 152, and ranks 2 and 4 may be mapped to the other of the first and second pumps 151 and 152).

For example, as illustrated in FIG. 7, the third indoor unit 63 of rank 1 and the first indoor unit 61 of rank 3 may be connected to the first pump 151, and the fourth indoor unit 64 of rank 2 and the second indoor unit 62 of rank 4 may be connected to the second pump 152.

As a result, among the four first valves 166 connected to the first pump 151, the first and third indoor unit valves 166*a* and 166*c* may be opened and the second and fourth indoor unit valves 166*b* and 166*d* may be closed. On the other hand, among the four second valves 167 connected to the second pump 152, the valves connected to the second and fourth indoor units 62 and 64 may be opened and the valves connected to the first and third indoor units 61 and 63 may be closed.

As such, since the first and second pumps 151 and 152 may be mapped to the first to fourth indoor units 61, 62, 63 and 64 according to the load of the indoor unit, the equal load may be distributed to the pumps.

The air conditioning system 1 may be operated according to the mapping result of the first and second pumps 151 and 152 and the first to fourth indoor units 61, 62, 63 and 64.

Figure 8A:
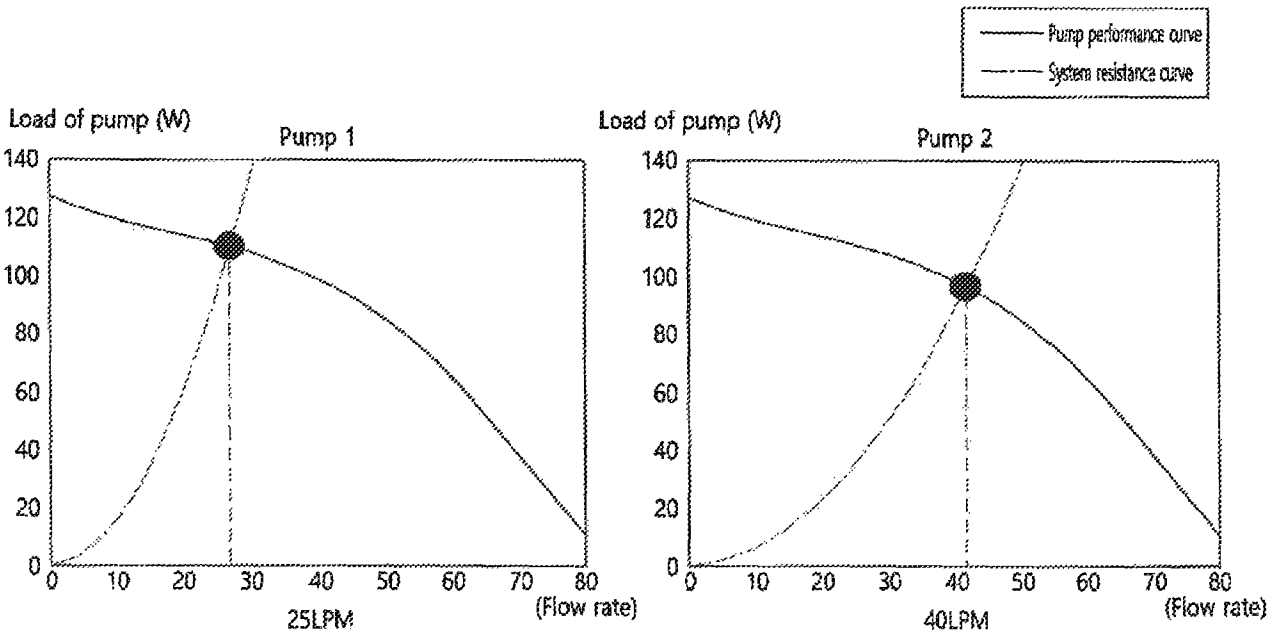
FIG. 8A is a graph showing a result of distributing the load of the pump considering only the capacity of the indoor unit.
Figure 8B:
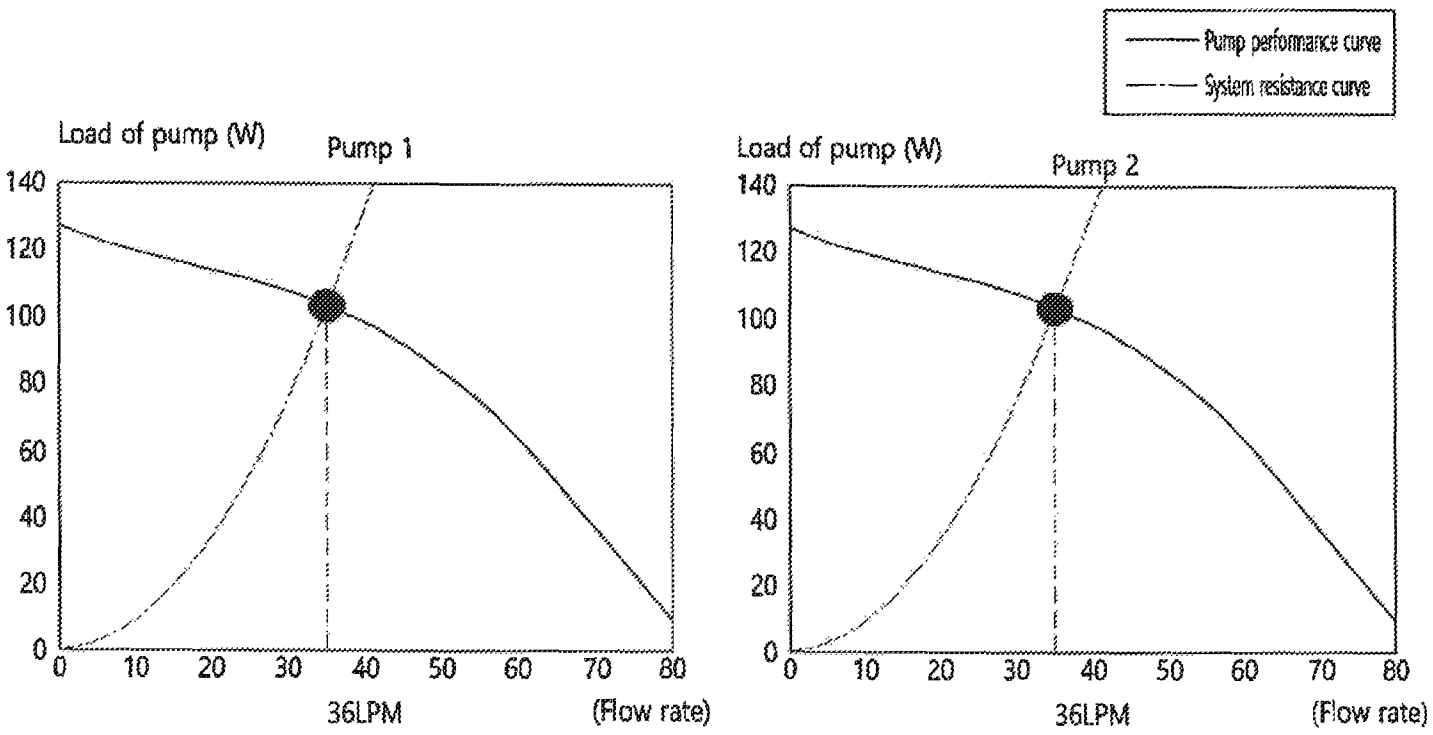
FIG. 8B is a graph showing a result of distributing the load of the pump considering the capacity of the indoor unit and the length of the indoor unit pipe according to an embodiment of the present disclosure.

FIG. 8A is a graph showing a result of distributing the load of the pump considering only the capacity of the indoor unit, and FIG. 8B is a graph showing a result of distributing the load of the pump considering the capacity of the indoor unit and the length of the indoor pipe according to an embodiment of the present disclosure.

In the graphs of FIGS. 8A and 8B, the horizontal axis represents the flow rate of the pump, and the vertical axis represents the load of the pump. In the graphs, the solid line represents the pump performance curve and the dotted line represents the system resistance curve. When the slope of the system resistance curve is large, it means that the pump load is large.

The flow rate of the pump may be formed at a point where the pump performance curve and the system resistance curve meet.

Referring to FIG. 8A, when the plurality of pumps are mapped to the plurality of indoor units considering only the capacity of the indoor unit, the slope of the system resistance curve of the first pump (pump 1) is formed relatively large, and the slope of the system resistance curve of the second pump (pump 2) is formed relatively small.

Therefore, the flow rate of the first pump is measured as 25 LPM, and the flow rate of the second pump is measured as 40 LPM. That is, in the case of FIG. 8A, it can be seen that the indoor unit is allocated such that the load is biased to the first pump and the flow rate decreases.

On the other hand, referring to FIG. 8*b*, when the plurality of pumps are mapped to the plurality of indoor units, based on a result of measuring the flow rate of the indoor unit pipe considering not only the capacity of the indoor unit but also the installation conditions such as the length of the indoor unit pipe and the pipe accessories, the slope of the system resistance curve of the first and second pumps is formed almost similarly.

Therefore, since both the flow rates of the first pump and the second pump are measured as 36 LPM, it can be seen that the loads of the indoor units are equally distributed to the first and second pumps. In addition, it can be seen that the sum (72 LPM) of the flow rates of the first and second pumps is larger than the sum (65 LPM) of the flow rates of the first and second pumps in FIG. 7A. This indicates that the performance of the system is improved.

Figure 9:
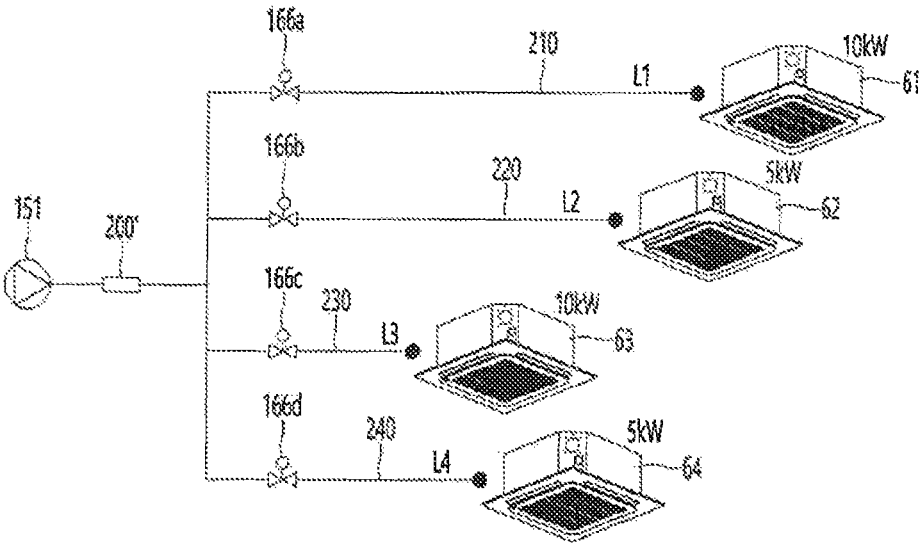
FIG. 9 is a schematic diagram illustrating a connection configuration between a first pump and a plurality of indoor units according to a second embodiment of the present disclosure.

FIG. 9 is a schematic diagram illustrating a connection configuration between a first pump and a plurality of indoor units, according to a second embodiment of the present disclosure.

Referring to FIG. 9, the air conditioning system according to the second embodiment of the present disclosure may be configured to measure the flow rate of the indoor unit by using a single flow rate meter 200'.

The single flow rate meter 200' may be installed at an inlet side or an outlet side of the first pump 151. As described above with reference to FIGS. 4A to 4D, when water is circulated by sequentially opening the first to fourth indoor units 61, 62, 63, and 64, the amount of water flowing into the first pump 151 or discharged from the first pump 151 may be measured through the flow rate meter 200'.

In this way, since the single flow rate meter is installed to measure the flow rate of the indoor unit, the cost consumed when the system performs the test drive may be reduced. The description of the air conditioning system according to the first embodiment may be applied to the other description of the air conditioning system according to the present embodiment.

Figure 10:
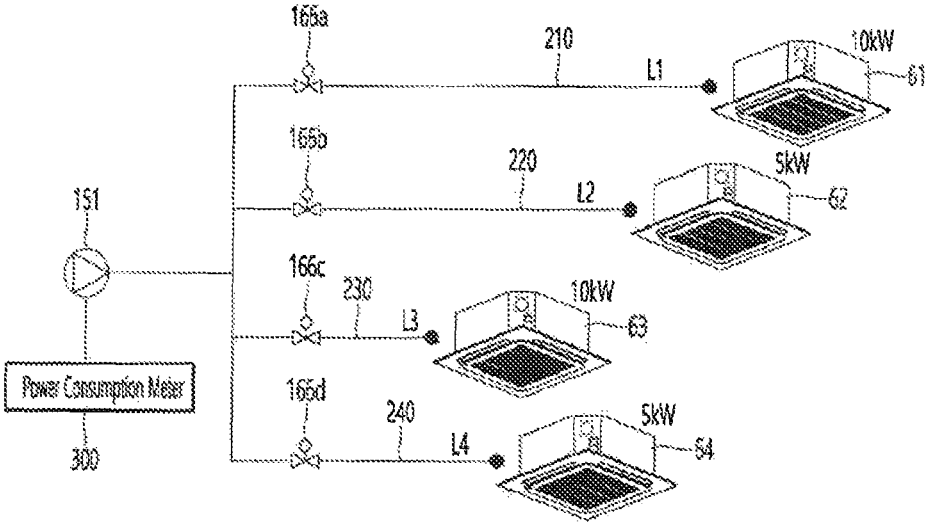
FIG. 10 is a schematic diagram illustrating a connection configuration between a first pump and a plurality of indoor units according to a third embodiment of the present disclosure.

FIG. 10 is a schematic diagram illustrating a connection configuration between a first pump and a plurality of indoor units according to a third embodiment of the present disclosure.

Referring to FIG. 10, when an air conditioning system 1 according to a third embodiment of the present disclosure is installed and then performs a test drive, a first pump 151 may be driven so as to determine loads of a plurality of indoor units, and may determine the amount of water flowing through the first pump 151 and the indoor units.

FIG. 10 is a diagram schematically illustrating the connection structure of the first pump 151 and first to fourth indoor units 61, 62, 63, and 64. A first pump 151 may be connected to first to fourth indoor units 61, 62, 63, and 64 through first to fourth indoor unit pipes 210, 220, 230, and 240. First to fourth indoor unit valves 166*a*, 166*b*, 166*c*, and 166*d* may be installed in the first to fourth indoor unit pipes 210, 220, 230, and 240, respectively.

The description of the first embodiment is applied to the description of the first to fourth indoor units 61, 62, 63, and 64, the first to fourth indoor unit pipes 210, 220, 230, and 240, and the first to fourth indoor unit valves 166*a*, 166*b*, 166*c*, and 166*d*.

A power consumption meter 300 capable of measuring power consumed when the first pump 151 is driven may be electrically connected to the first pump 151.

Under these installation conditions, when the first pump 151 and the first to fourth indoor units 61, 62, 63 and 64 are sequentially connected one by one and the first pump 151 is driven, the power consumption of the first pump 151 may be measured.

In this case, the measured power consumption may correspond to the flow rate described in the first embodiment and may be understood as a result of reflecting installation conditions such as the capacity of the indoor unit, the length of the indoor unit pipe, and accessories of the indoor unit pipe. Hereinafter, such a measurement method will be described in detail with reference to the drawings.

Figure 11A:
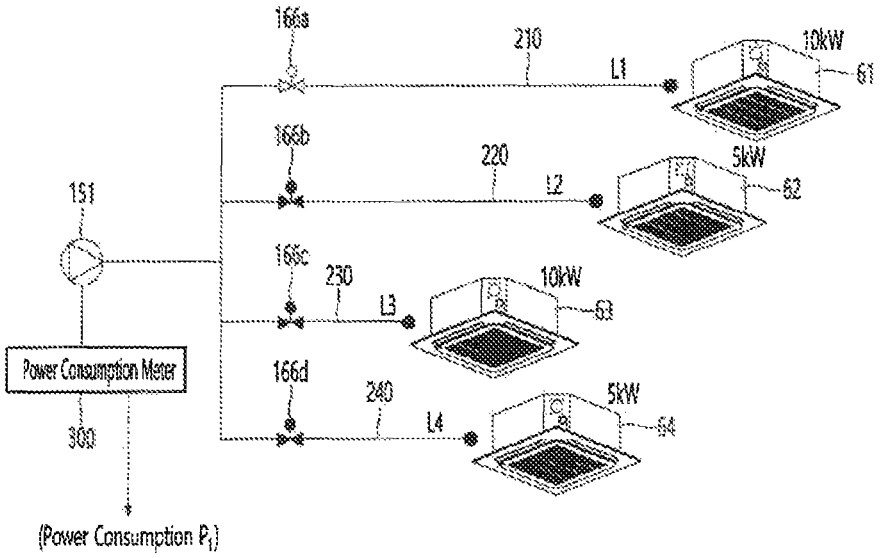
FIGS. 11A to 11D are schematic diagrams illustrating a state in which the first pump and the plurality of indoor units according to the third embodiment of the present disclosure are sequentially connected one by one to measure a flow rate of an indoor unit pipe.
Figure 11B:
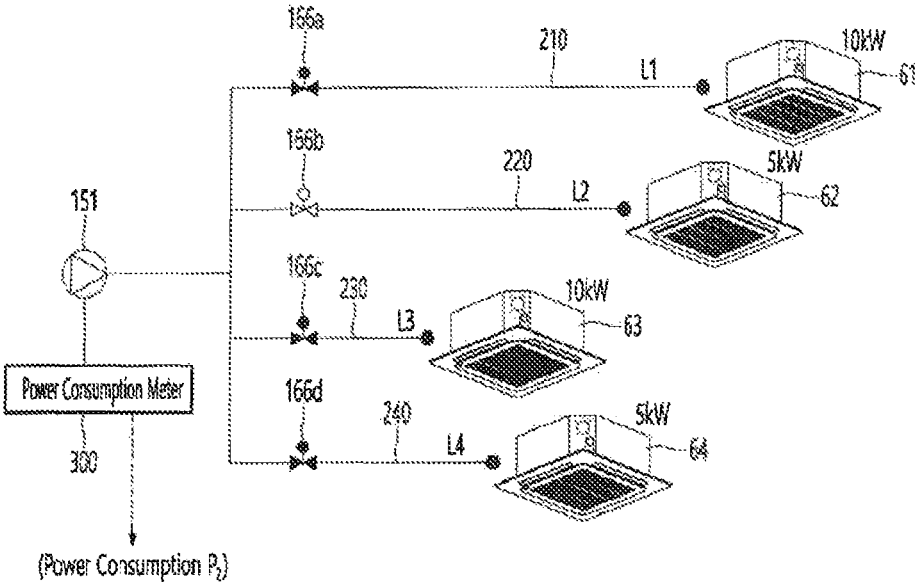
Figure 11C:
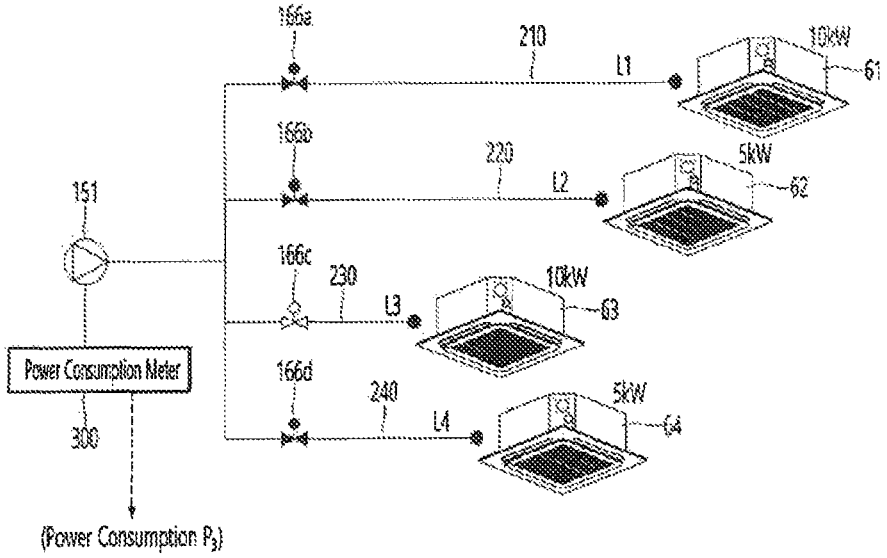
Figure 11D:
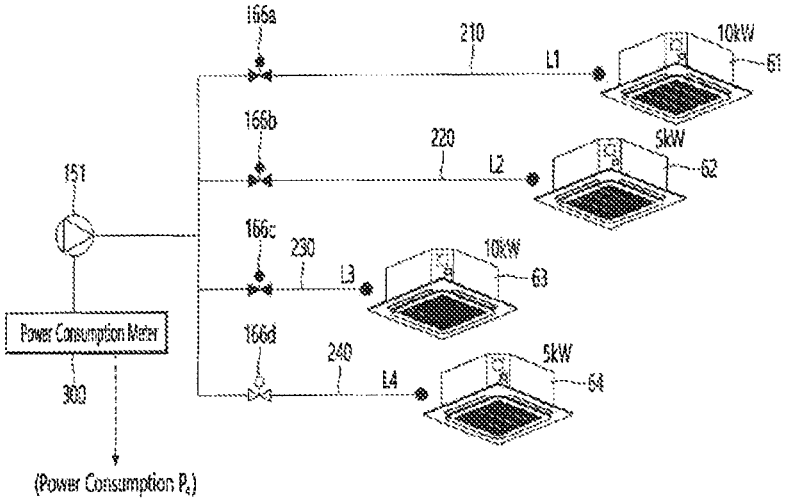
Figure 12:
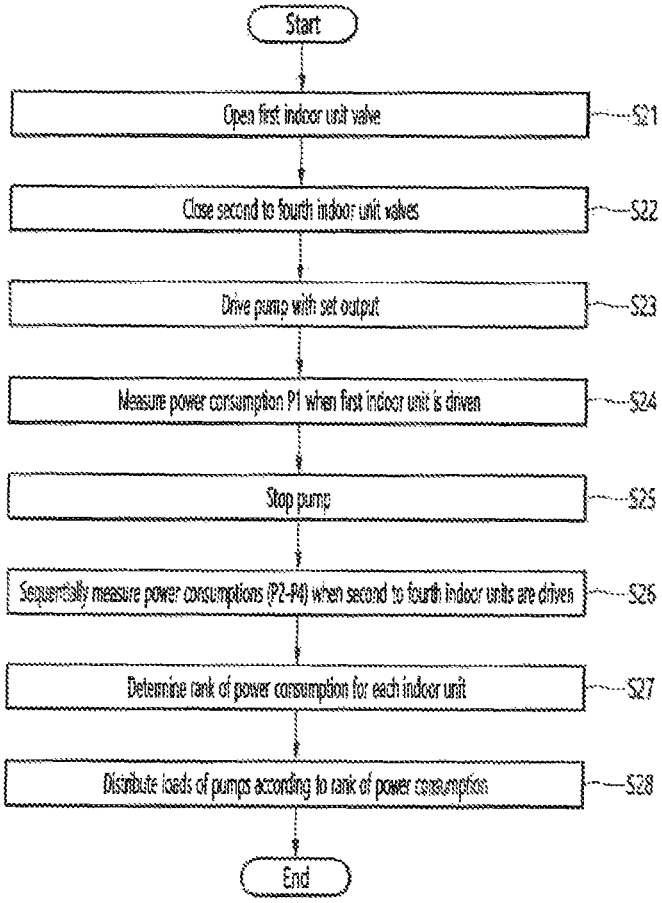
FIG. 12 is a flowchart illustrating a method for controlling an air conditioning system according to the third embodiment of the present disclosure.

FIGS. 11A to 11D are schematic diagrams illustrating a state in which the first pump and the plurality of indoor units according to the third embodiment of the present disclosure are sequentially connected one by one to measure a flow rate of an indoor unit pipe, and FIG. 12 is a flowchart illustrating a method for controlling an air conditioning system according to the third embodiment of the present disclosure.

A method for determining the load of the indoor unit according to the third embodiment of the present disclosure will be described with reference to FIGS. 11*a* to 11*d* and 12 together.

First, as illustrated in FIG. 11A, a controller 250 opens a first indoor unit valve 166*a* and closes second to fourth indoor unit valves 166*b*, 166*c*, and 166*d* (S21, S22).

A first pump 151 is driven with a set output. For example, the set output may be the maximum output of the first pump 151 (S23).

When the first pump 151 is driven, water discharged from the first pump 151 flows through the first indoor unit pipe 210, and the flow through the second to fourth indoor unit pipes 220, 230, and 240 may be limited.

While water flows through the first indoor unit pipe 210, power consumption of the first pump 151 may be measured. The measured power consumption may constitute first power consumption P1 corresponding to the first indoor unit 61 (S24).

Such measurement may be made for a set time, and then the controller 250 may stop driving the first pump 151. The measured power consumption is stored in a memory 260, and this may be determined as the load of the first indoor unit 61 (S25).

In this way, the loads of the second to fourth indoor units 62, 63 and 64 may be sequentially determined.

That is, in order to determine the load of the second indoor unit 62, as illustrated in FIG. 11B, the controller 250 opens the second indoor unit valve 166*b* and closes the first, third, and fourth indoor unit valves 166*a*, 166*c*, and 166*d*.

When the first pump 151 is driven with a set output, water discharged from the first pump 151 flows through the second indoor unit pipe 220, and the flow through the first, third, and fourth indoor unit pipes 210, 230, and 240 may be limited.

In this process, second power consumption P2 of the first pump 151 may be measured. The measured power consumption is stored in the memory 260, and this may be determined as the load of the second indoor unit 62.

Similarly, in order to determine the load of the third indoor unit 63, as illustrated in FIG. 11C, the controller 250 opens the third indoor unit valve 166*c* and closes the first, second, and fourth indoor unit valves 166*a*, 166*b*, and 166*d*.

When the first pump 151 is driven with a set output, water discharged from the first pump 151 flows through the third indoor unit pipe 230, and the flow through the first, second, and fourth indoor unit pipes 210, 220, and 240 may be limited.

In this process, third power consumption P3 of the first pump 151 may be measured. The measured power consumption is stored in the memory 260, and this may be determined as the load of the third indoor unit 63.

Finally, in order to determine the load of the fourth indoor unit 64, as illustrated in FIG. 11D, the controller 250 opens the fourth indoor unit valve 166*d* and closes the first, second, and third indoor unit valves 166*a*, 166*b*, and 166*c*.

When the first pump 151 is driven with a set output, water discharged from the first pump 151 flows through the fourth indoor unit pipe 240, and the flow through the first, second, and third indoor unit pipes 210, 220, and 230 may be limited.

In this process, fourth power consumption P4 of the first pump 151 may be measured. The measured power consumption is stored in the memory 260, and this may be determined as the load of the fourth indoor unit 64.

For example, the measured power consumption may change little by little over time, and the maximum value among the measured values may be determined as the power consumption (S26).

In the above-described method, the power consumption of the first to fourth indoor units is measured, and the rank of the power consumption for each indoor unit is determined. The rank of the power consumption may correspond to the load rank for each indoor unit. According to the rank of the power consumption, mapping information of the first and second pumps 151 and 152 and the first to fourth indoor units 61, 62, 63 and 64 is determined, and the loads of the first and second pumps are equally distributed (S27, S28).

Figure 13:
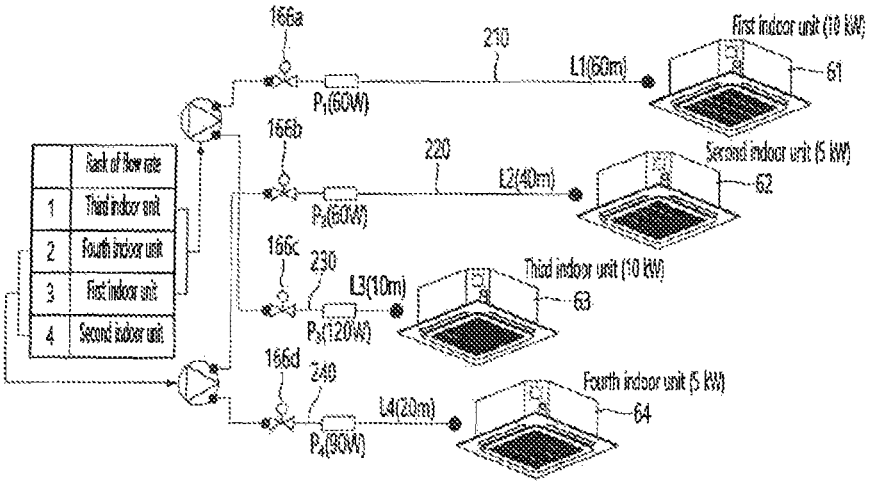
FIG. 13 is a schematic diagram illustrating a result of mapping a plurality of pumps and a plurality of indoor units according to the third embodiment of the present disclosure.

FIG. 13 illustrates the mapping result of the first and second pumps 151 and 152 with respect to the first to fourth indoor units 61, 62, 63, and 64. Details will be described in detail with reference to FIG. 13.

FIG. 13 is a schematic diagram illustrating a result of mapping a plurality of pumps and a plurality of indoor units according to the third embodiment of the present disclosure.

Referring to FIG. 13, power consumption of the first pump 151 may be measured through the power consumption meter 300 after the pump is operated for each indoor unit. It may be determined that as the measured power consumption increases, the load of the indoor unit is small, and as the measured power consumption decreases, the load of the indoor unit is large.

As a result of the measuring, for example, the first power consumption P1 may be 60 W, the second power consumption P2 may be 60 W, the third power consumption P3 may be 120 W, and the fourth power consumption P4 may be 90 W. Therefore, the rank of the power consumption rate of the third indoor unit 63 may be first, the rank of the power consumption of the fourth indoor unit 64 may be second, the rank of the power consumption of the first indoor unit 61 may be third, and the rank of the power consumption of the second indoor unit 62 may be fourth.

Based on the rank of the power consumption, ranks 1 and 3 may be mapped to one of the first and second pumps 151 and 152, and ranks 2 and 4 may be mapped to the other of the first and second pumps 151 and 152).

For example, as illustrated in FIG. 13, the third indoor unit 63 of rank 1 and the first indoor unit 61 of rank 3 may be connected to the first pump 151, and the fourth indoor unit 64 of rank 2 and the second indoor unit 62 of rank 4 may be connected to the second pump 152.

As a result, among the four first valves 166 connected to the first pump 151, the controller 250 may open the first and third indoor unit valves 166*a* and 166*c* and may close the second and fourth indoor unit valves 166*b* and 166*d*. On the other hand, among the four second valves 167 connected to the second pump 152, the controller 250 may open the valves connected to the second and fourth indoor units 62 and 64 and may close the valves connected to the first and third indoor units 61 and 63.

As such, since the first and second pumps 151 and 152 may be mapped to the first to fourth indoor units 61, 62, 63 and 64 according to the load of the indoor unit, the equal load may be distributed to the pumps.

The air conditioning system 1 may be operated according to the mapping result of the first and second pumps 151 and 152 and the first to fourth indoor units 61, 62, 63 and 64.

The "flow rate meter" described in the first and second embodiments and the "power consumption meter" described in the third embodiment are devices for measuring the load of the indoor unit, and may be collectively referred to as "indoor load measurement device".

INDUSTRIAL APPLICABILITY

The present disclosure relates to an air conditioning system and a method for controlling the same. The load per pump may be evenly distributed considering installation conditions of a plurality of indoor units, and thus, it is possible to secure the load capacity of the system and reduce power consumption. Therefore, the present disclosure is remarkably industrially applicable.

The invention claimed is:

1. An air conditioning system, comprising:

an outdoor unit through which a refrigerant circulates, the outdoor unit including a compressor and an outdoor heat exchanger;

a plurality of indoor units to which a fluid is supplied;

a heat exchanger configured to perform heat exchange between the refrigerant and the fluid;

at least one indoor unit pipe that connects the heat exchanger to the plurality of indoor units, the at least one indoor unit pipe being configured to guide circulation of the fluid in the heat exchanger and the plurality of indoor units;

a plurality of pumps installed in the at least one indoor unit pipe to forcibly circulate the fluid, the plurality of pumps including a first pump and a second pump;

at least one flow rate meter configured to measure loads of the plurality of indoor units based on capacities of the plurality of indoor units and a length of the at least one indoor unit pipe when the plurality of indoor units is mapped to the plurality of pumps, the at least one flow rate meter being installed in the at least one indoor unit pipe and configured to measure a flow rate of the fluid circulating in the plurality of pumps and the plurality of indoor units; and a controller configured to determine the loads of the plurality of indoor units based on the flow rate measured by the at least one flow rate meter, wherein the controller is configured to:

determine ranks of the plurality of indoor units based on flow rates measured for the plurality of indoor units;

map, to the first pump of the plurality of pumps, at least one first indoor unit having a first rank among the plurality of indoor units; and map, to the second pump of the plurality of pumps, at least one second indoor unit having a second rank among the plurality of indoor units.

2. The air conditioning system according to claim 1, wherein the controller is configured to:

map, to the first pump of the plurality of pumps, two first indoor units having a highest rank and a lowest rank among the plurality of indoor units; and map, to the second pump of the plurality of pumps, two second indoor units having a middle rank among the plurality of indoor units.

3. The air conditioning system according to claim 1, wherein the at least one flow rate meter includes a plurality of flow rate meters, wherein the at least one indoor unit pipe comprises a plurality of indoor unit pipes, and wherein the plurality of flow rate meters is installed in the plurality of indoor unit pipes connected to the plurality of indoor units.

4. The air conditioning system according to claim 1, wherein the at least one indoor unit pipe comprises a plurality of indoor unit pipes corresponding to the plurality of indoor units, and wherein each of the plurality of indoor unit pipes is provided with a valve configured to selectively allow supply of fluid to the plurality of indoor units.

5. The air conditioning system according to claim 1, wherein the fluid comprises water.

6. A method for controlling an air conditioning system including an outdoor unit through which a refrigerant circulates, the outdoor unit including a compressor and an outdoor heat exchanger, a plurality of indoor units to which fluid is supplied, a heat exchanger configured to perform heat exchange between the refrigerant and the fluid, and a plurality of pumps configured to forcibly supply the fluid to the plurality of indoor units, the method comprising:

sequentially connecting the plurality of pumps to the plurality of indoor units and driving the connected pump;

determining loads of a plurality of indoor units measured while each pump is driven, using:

at least one flow rate meter configured to measure an amount of fluid circulating through the plurality of pumps and the plurality of indoor units, or at least one power consumption meter configured to measure power consumption of the plurality of pumps; and determining ranks for the determined loads of the plurality of indoor units based on the amount of fluid for the plurality of indoor units or the power consumption of the plurality of pumps, and mapping the plurality of indoor units and the plurality of pumps based on the ranks, the mapping comprising:

mapping, to a first pump of the plurality of pumps, at least one first indoor unit having a first rank among the plurality of indoor units, and mapping, to a second pump of the plurality of pumps, at least one second indoor unit having a second rank among the plurality of indoor units.

7. The method according to claim 6, wherein the mapping of the plurality of indoor units and the plurality of pumps based on the determined ranks comprises:

mapping, to the first pump of the plurality of pumps, two indoor units having a highest rank and a lowest rank among the ranks of the loads of the plurality of indoor units; and mapping, to the second pump of the plurality of pumps, two different indoor units having a middle rank among the ranks of the loads of the plurality of indoor units.

8. The method according to claim 6, wherein the plurality of indoor units include first to fourth indoor units, and the plurality of pumps include the first and second pumps, and wherein two indoor units corresponding to first and fourth ranks among the determined ranks are mapped to the first pump, and two indoor units corresponding to second and third ranks are mapped to the second pump.

9. An air conditioning system, comprising:

an outdoor unit through which a refrigerant circulates;

a plurality of indoor units to which a fluid is supplied;

a heat exchanger configured to perform heat exchange between the refrigerant and the fluid;

at least one indoor unit pipe that connects the heat exchanger to the plurality of indoor units;

a plurality of pumps installed in the at least one indoor unit pipe to forcibly circulate the fluid;

at least one power consumption meter configured to measure loads of the plurality of indoor units when the plurality of indoor units is mapped to the plurality of pumps, the at least one power consumption meter being configured to measure power consumption output by the plurality of pumps; and a controller configured to determine the loads of the plurality of indoor units based on the power consumption output measured by the at least one power consumption meter, wherein the controller is configured to:

determine ranks of the plurality of indoor units based on power consumption outputs measured for the plurality of pumps;

map, to a first pump of the plurality of pumps, at least one first indoor unit having a first rank among the plurality of indoor units; and map, to a second pump of the plurality of pumps, at least one second indoor unit having a second rank among the plurality of indoor units.

10. The air conditioning system according to claim 9, wherein the controller is further configured to:

map, to the first pump of the plurality of pumps, two indoor units having a highest rank and a lowest rank among the plurality of indoor units; and map, to the second pump of the plurality of pumps, two different indoor units corresponding to a middle rank among the plurality of indoor units.

11. The air conditioning system according to claim 9, wherein the at least one indoor unit pipe comprises a plurality of indoor unit pipes corresponding to the plurality of indoor units, and wherein each of the plurality of indoor unit pipes is provided with a valve configured to selectively allow supply of fluid to the plurality of indoor units.

* * * * *